US011015414B1

(12) United States Patent
Kennedy et al.

(10) Patent No.: US 11,015,414 B1
(45) Date of Patent: May 25, 2021

(54) SHEARABLE TOOL ACTIVATION DEVICE

(71) Applicant: RESERVOIR GROUP INC, Houston, TX (US)

(72) Inventors: Mathew John Kennedy, West Lakes (AU); Michael Desmond Slattery, Paradise (AU)

( * ) Notice: Subject to any disclaimer, the term of this patent is extended or adjusted under 35 U.S.C. 154(b) by 0 days.

(21) Appl. No.: 16/672,681

(22) Filed: Nov. 4, 2019

(51) Int. Cl.
*E21B 33/12* (2006.01)
*E21B 29/00* (2006.01)

(52) U.S. Cl.
CPC ..... *E21B 33/12* (2013.01); *E21B 29/00* (2013.01)

(58) Field of Classification Search
CPC ..... E21B 33/12; E21B 29/00
See application file for complete search history.

(56) References Cited

U.S. PATENT DOCUMENTS 2,799,349 A 7/1957 Clark et al.
2,799,479 A 7/1957 Kammerer et al.
3,339,647 A 9/1967 Kammerer et al.
6,209,643 B1 4/2001 Nguyen et al.
8,573,295 B2 11/2013 Johnson et al.
9,101,978 B2 8/2015 Xu et al.
2011/0132619 A1 6/2011 Agrawal et al.
2012/0006562 A1* 1/2012 Speer ..... E21B 23/04 166/373
2012/0012326 A1 1/2012 Darby et al.
2012/0217021 A1 8/2012 Cravatte et al.
2015/0068762 A1* 3/2015 Naedler ..... E21B 34/14 166/373

FOREIGN PATENT DOCUMENTS

EP 2333232 A2 6/2011
GB 2536441 A 9/2016

* cited by examiner

*Primary Examiner* — Kristyn A Hall
*Assistant Examiner* — Dany E Akakpo
(74) *Attorney, Agent, or Firm* — Shackelford, Bowen, McKinley & Norton, LLP; Henry Ehrlich

(57) ABSTRACT

An exemplary activation device for a downhole tool includes an outer shell configured to sealingly engage a seat and configured to be sheared by the seat whereby the activation device can pass through the seat.

20 Claims, 6 Drawing Sheets

SHEARABLE TOOL ACTIVATION DEVICE

BACKGROUND

This section provides background information to facilitate a better understanding of the various aspects of the disclosure. It should be understood that the statements in this section of this document are to be read in this light, and not as admissions of prior art.

In the wellbore industry activation devices, known as tripping balls, darts, and plugs are used for different operations requiring a pressure up event. Many different kinds of downhole tools are known to be controlled using activation balls, common examples are tools used in drill strings and/or tools used in production strings used to transport production fluids through the borehole.

Activation balls are normally substantially spherical and are dropped into the wellbore from an insertion point at the surface and travel through the wellbore to the downhole tool. The activation ball may be carried by drilling mud or another fluid that is pumped through the wellbore. When the activation ball reaches the downhole tool, the ball lands on a seat causing fluid and/or hydraulic pressure to be applied to the ball and the seat. The fluid pressure is generally applied from the surface and the force resulting from the pressure is used to operate the downhole tool, typically by moving the ball and the seat, or some mechanism connected to it to change the activation status of the downhole tool, for example to activate or de-activate the tool.

SUMMARY

An exemplary activation device for a downhole tool includes an outer shell configured to sealingly engage a seat and configured to be sheared by the seat whereby the activation device can pass through the seat.

An exemplary wellbore system includes an actuatable downhole tool including a seat having a throughbore and a cutting edge circumscribing the throughbore and an activation device including an outer shell formed of a consolidated sand and encapsulating an unconsolidated sand. The activation device sized to land on the seat and in response to hydraulic pressure actuate the downhole tool, whereby the cutting edge shears the outer shell to allow the activation device to pass through the throughbore.

An exemplary method includes landing an activation device on a seat of a tool located in a tubular string in a wellbore, the activation device having an outer shell formed of a consolidated sand, actuating the tool in response to a hydraulic pressure applied to the activation device landed on the seat, shearing the outer shell with the seat in response to the hydraulic pressure and passing the activation device through the seat.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion. As will be understood by those skilled in the art with the benefit of this disclosure, elements and arrangements of the various figures can be used together and in configurations not specifically illustrated without departing from the scope of this disclosure.

DETAILED DESCRIPTION

Figure 1:
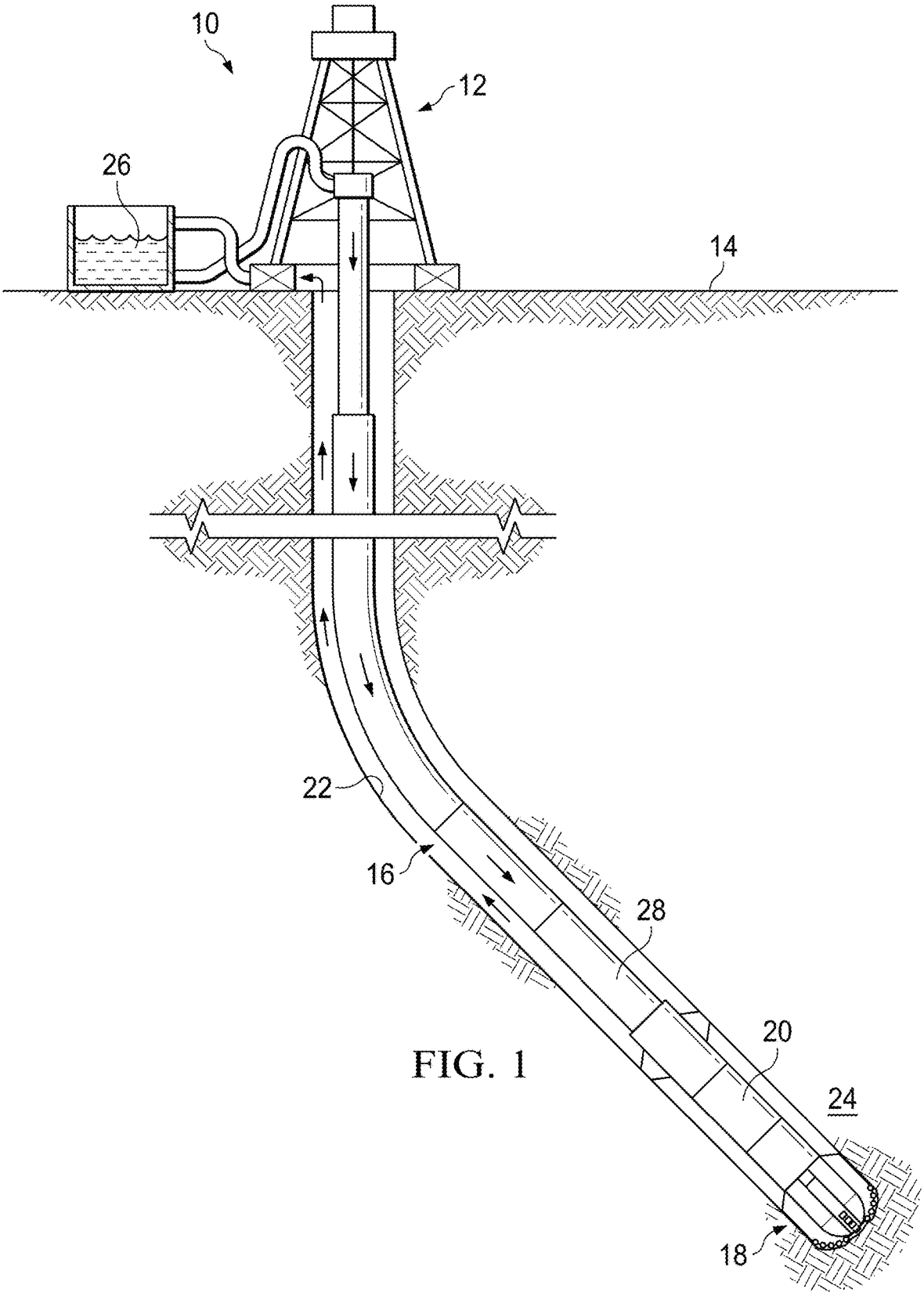
FIG. 1 illustrates an exemplary wellbore system in which the shearable activation device can be used.

It is to be understood that the following disclosure provides many different embodiments, or examples, for implementing different features of various illustrative embodiments. Specific examples of components and arrangements are described below to simplify the disclosure. These are, of course, merely examples and are not intended to be limiting. For example, a figure may illustrate an exemplary embodiment with multiple features or combinations of features that are not required in one or more other embodiments and thus a figure may disclose one or more embodiments that have fewer features or a different combination of features than the illustrated embodiment. Embodiments may include some but not all the features illustrated in a figure and some embodiments may combine features illustrated in one figure with features illustrated in another figure. Therefore, combinations of features disclosed in the following detailed description may not be necessary to practice the teachings in the broadest sense and are instead merely to describe particularly representative examples. In addition, the disclosure may repeat reference numerals and/or letters in the various examples. This repetition is for the purpose of simplicity and clarity and does not itself dictate a relationship between the various embodiments and/or configurations discussed.

FIG. 1 is a schematic illustration of an exemplary wellbore system, generally denoted by the numeral 10, in which embodiments of the shearable activation device may be incorporated. With additional reference to FIG. 2-11, system 10 includes a rig 12 located at a surface 14 and a tubular string 16, drill string in this example, suspended from rig 12. A drill bit 18 is disposed with a bottom hole assembly ("BHA") 20 and deployed on drill string 16 to drill borehole 22 into formation 24. System 10 includes drilling fluid or mud 26 that can be circulated from surface 14 through the axial bore of tubular string 16 and returned to surface 14 through the annulus between drill string 16 and formation 24. Tubular string 16 includes a downhole tool 28 that is operated via shearable activation device 30.

Figure 2:
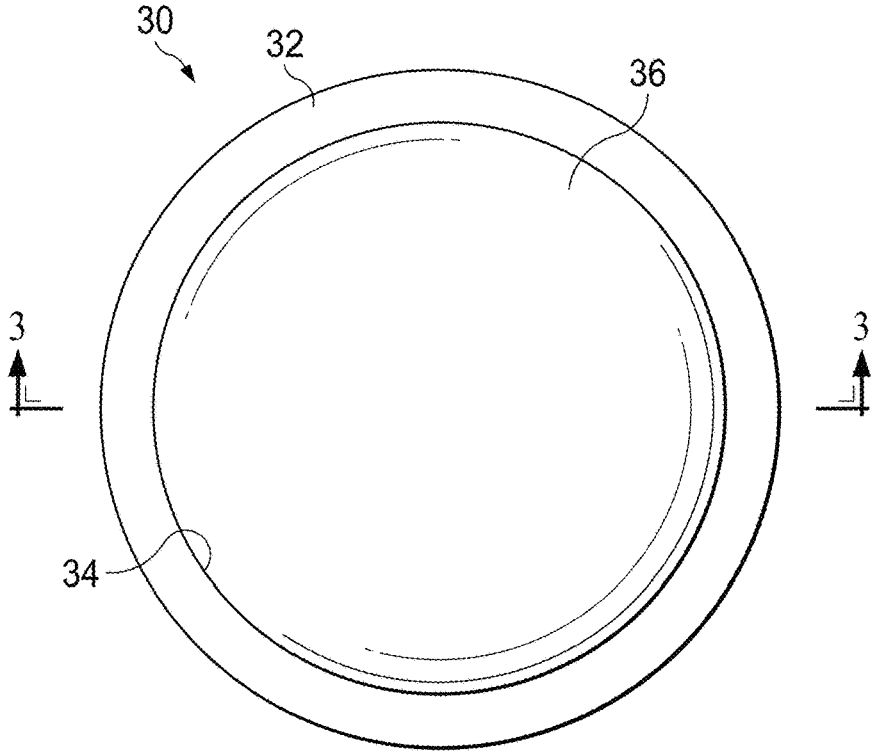
FIG. 2 is a schematic illustration of an exemplary embodiment of a shearable activation device according to one or more aspects of the disclosure.
Figure 3:
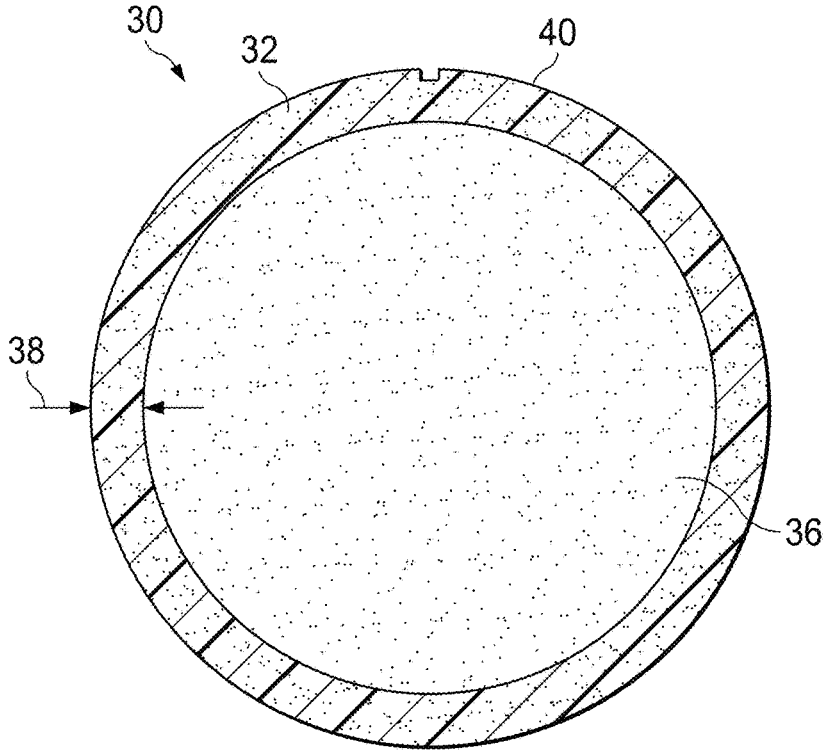
FIG. 3 is a cut-away view of the activation device along the line 3-3 of FIG. 2.

FIGS. 2 and 3 illustrate an exemplary embodiment of shearable activation device 30. Shearable activation device 30 includes an outer shell 32 defining a body having a compressive strength. In this embodiment, the internal volume 34 of outer shell 32 is filled, or substantially filled, with an unconsolidated material 36, also referred to as core 36. In some embodiments, internal volume 34 may be void or substantially void. Activation device 30 is configured to sealing engage a seat of the downhole tool 28 and then to pass through the seat as hydraulic pressure is applied to the actuation device landed on the seat shears or broaches a portion of outer shell 32. Broaching outer shell 32 may result in outer shell 32 passing through the seat due to reduction of the diameter of outer shell 32 and or result in outer shell 32 fracturing and the fractured outer shell 32 and unconsolidated core 36 passing through the seat. Broaching is used herein to mean removing a portion of the outer shell or penetrating the outer shell. In some embodiments, the seat of the downhole tool is configured to broach outer shell 32 so that outer shell 32 may pass through the seat. Outer shell 32 may remain intact as it passes through the seat.

Activation device 30 is designed to have sufficient compressive strength to actuate the downhole tool without outer shell 32 being compromised. As will be understood by those skilled in the art with benefit of this disclosure, outer shell 32 may provide the required compressive strength, inner unconsolidated material 36 may provide compressive strength, and in some embodiments an internal consolidated structure may provide compressive strength to activation device 30. Activation device 30 may have a compressive strength from 10 to 140 MPa. Activation device 30 may have a compressive strength of between 60 and 100 MPa. Activation device 30 may have a compressive strength of between 70 and 90 MPa. In at least one embodiment, activation device 30 has a compressive strength of 80 MPa. Activation device 30 has the required structural strength if outer shell 32 can withstand impact of activation device 30 against the sides of the borehole or the tubular bore during passage of the activation device, the impact of the activation device on the seat of the downhole tool, and the hydraulic force applied to the activation device through the drilling fluid to activate the downhole tool. Activation device 30 may have a compressive strength such that the shape and size of the activation device remains substantially constant at least during passage of the activation device to the downhole tool.

Activation device 30 may comprise a substantially spherical ball or may be cylindrical in shape. The seat of most downhole tools is adapted to receive a substantially spherical ball. A spherical activation device obviates the need to control the orientation of the activation device relative to the seat and/or tool and therefore optimizes contact between the ball and the seat. The activation device may be a drop ball.

Activation device 30 may have an external or outer diameter of between 10 and 100 mm, optionally between 30 and 70 mm, and in some embodiments about 54 mm. The external or outer diameter is small enough to pass through the borehole of a downhole well (drill string) and large enough to engage with a typical seat of a typical downhole tool to activate and/or deactivate the downhole tool.

Exemplary activation device 30 shown in FIGS. 1 and 2 has an outer diameter of approximately 54 mm. Outer shell 32 has a wall thickness for example in a range of about 2 mm to 8 mm. In the example of FIGS. 1 and 2, outer shell 32 has a wall thickness 38 of about 4 mm. In another exemplary embodiment, wall thickness 38 is about 7 mm.

Outer shell 32 is constructed of a consolidated material that is resistant to dissolving in the drilling fluid, resistant to being eroded by the drilling fluid and non-reactive with the drilling fluid. Exemplary activation device 30 is constructed of sand by an additive manufacturing process, i.e., 3D printing. In an embodiment, outer shell 32 is consolidated by resin bonding. An exemplary outer shell 32 is consolidated with a furan resin binder. A bed of sand mixed with the resin is presented. A printing head dispenses a catalyst, e.g., acid, onto the sand bed to form structural, consolidated outer shell 32 that encapsulates an unconsolidated sand core 36. In an example, outer shell 32 is formed of approximately 99.8 percent silica sand with a grain size of about 0.105 mm. Other non-limiting examples of outer shell 32 is constructed of sand with granulation of 0.14 mm, 0.19 mm, and 0.25 mm. The type of sand, and the binder, may be varied to achieve desired temperature or chemical resistance.

Figure 4:
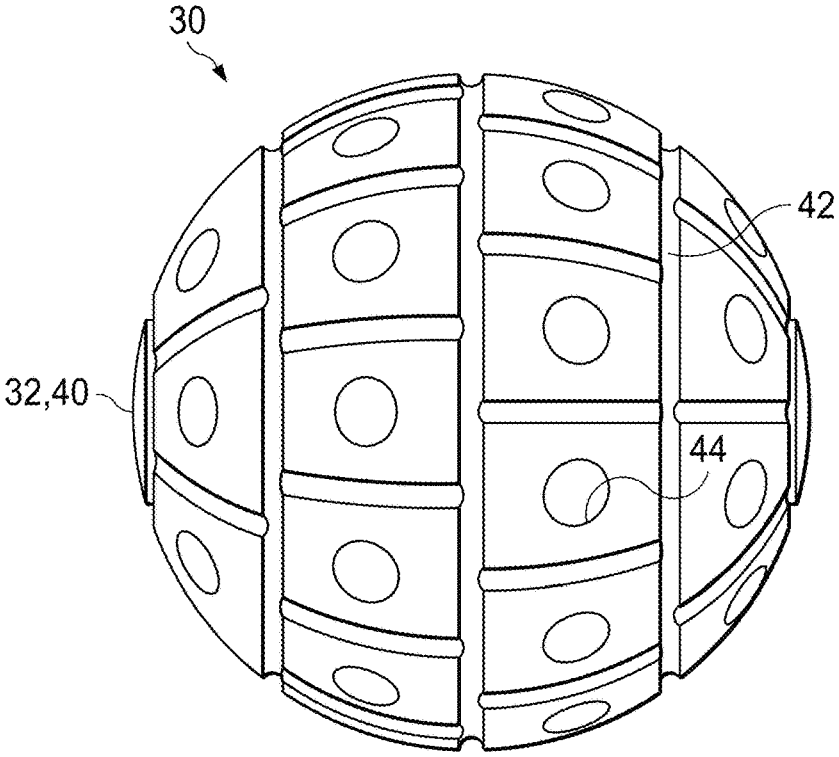
FIG. 4 illustrates an external view of an exemplary shearable activation device.

The external surface 40 of outer shell 32 may be formed in different configurations. For example, in FIG. 2 external surface 40 is substantially smooth. In some embodiments, such as illustrated in FIG. 4, external surface 40 may have grooves 42, also referred to as fracture grooves or lines. These grooves may promote fracturing outer shell 32 when it is broached by the seat of the downhole tool. In some embodiments, external surface 40 may include dimples 44. Dimples 44 may create a thin turbulent boundary layer around activation tool 30 as it travels downhole reducing the drag. Although FIG. 4 illustrates both grooves 42 and dimples 44, external surface 40 may include only grooves 42 or dimples 44.

Figure 5:
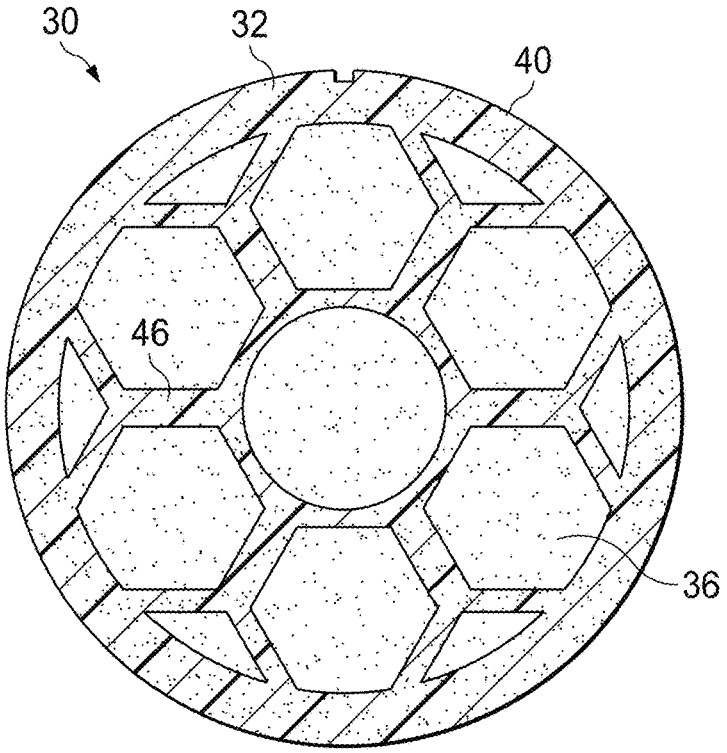
FIGS. 5-8 are section views of various exemplary shearable activation devices.

FIG. 5 is a cross-sectional view of another exemplary shearable activation device 30 including internal structure 46. Internal structure 46 is constructed of a consolidated material and coupled to outer shell 32 to provide structural support to outer shell 32. Internal structure 46 may be constructed of the same consolidated sand as outer shell 32. The internal volume of outer shell 32, between internal consolidated structure 46, is filled with unconsolidated sand 36.

Figure 6:
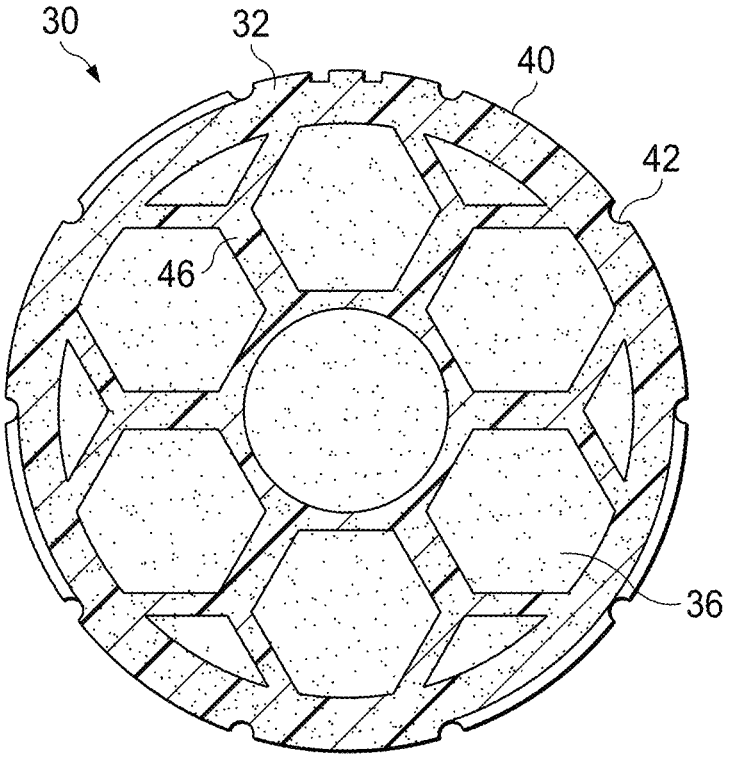

FIG. 6 is a cross-sectional view of another exemplary shearable activation device 30 including internal structure 46 and external fracture grooves 42. Internal structure 46 is constructed of a consolidated material and coupled to outer shell 32 to provide structural support to outer shell 32. Internal structure 46 may be constructed of the same consolidated sand as outer shell 32. The internal volume of outer shell 32, between internal consolidated structure 46, is filled with unconsolidated sand 36. External surface 40 of outer shell 32 includes one or more grooves 42 that may expedite dispersion of outer shell 32 once it is broached by the seat of the downhole tool.

Figure 7:
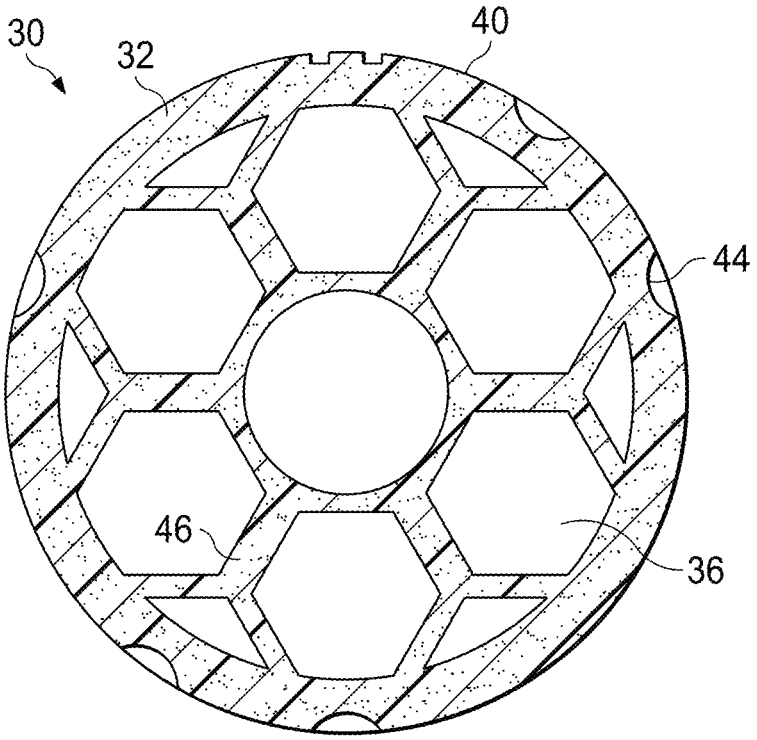

FIG. 7 illustrates another cross-sectional view of an exemplary shearable activation device 30 including internal structure 46 and external dimples 44. Internal structure 46 is constructed of a consolidated material and coupled to outer shell 32 to provide structural support to outer shell 32. Internal structure 46 may be constructed of the same consolidated sand as outer shell 32. The internal volume of outer shell 32, between internal consolidated structure 46, is filled with unconsolidated sand 36. External surface 40 of outer shell 32 includes one or more dimples 44 that may reduce drag as activation device 30 passes through the drilling fluid in ball drop applications.

Figure 8:
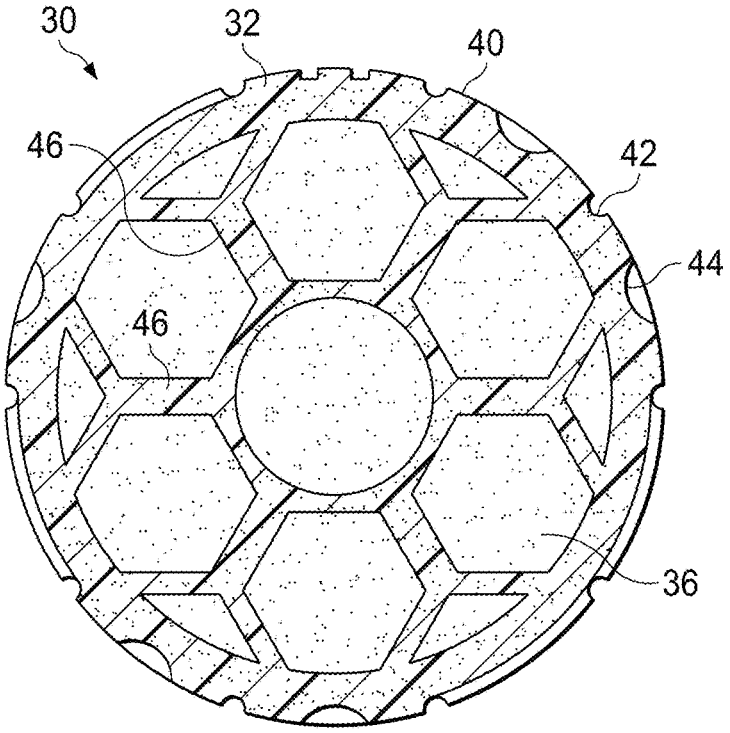

FIG. 8 illustrates another cross-sectional view of an exemplary shearable activation device 30 including internal structure 46, external grooves 42 and external dimples 44. Internal structure 46 is constructed of a consolidated material and coupled to outer shell 32 to provide structural support to outer shell 32. Internal structure 46 may be constructed of the same consolidated sand as outer shell 32. The internal volume of outer shell 32, between internal consolidated structure 46, is filled with unconsolidated sand 36. External surface 40 of outer shell 32 includes one or more grooves 42 that may expedite dispersion of outer shell 32 once it is broached by the seat of the downhole tool and one or more dimples 44 that may reduce drag as activation device 30 passes through the drilling fluid in ball drop applications.

Figure 9:
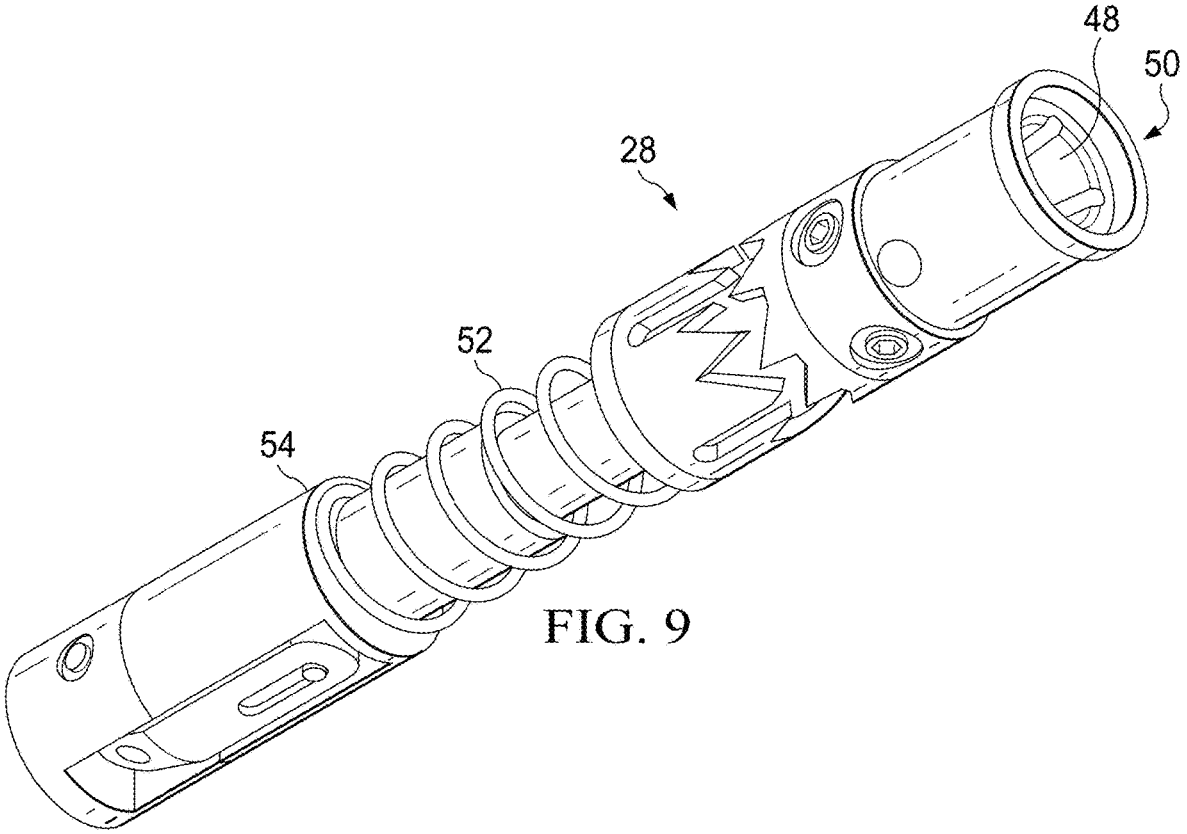
FIG. 9 illustrates an exemplary downhole tool actuatable with a shearable activation device.

FIG. 9 illustrates an exemplary downhole tool 28, which is described with additional reference to FIGS. 1-8. Examples of downhole tool 28 that could be operated using the activation device 30 include without limitations hole-enlargers, activation devices in a core barrel assembly, inflatable packers, circulating subs and multi-activation subs. Downhole tool 28 includes a seat 48 upon which the activation device 30 lands. Activation device 30 lands on seat 48 and substantially seals the bore 50 across seat 48. The hydraulic pressure of the drilling fluid acting on activation device 30 compresses spring 52 until it reaches a mechanical stop 54. Spring 52 may be a mechanical or fluidic spring. The sudden impact of activation device 30 on seat 48 and the continued momentum causes activation device 30 to pass through seat 48 as outer shell 32 or a portion thereof is sheared away. The shearing may expose unconsolidated core 36 which will pass through the seat and disperse in the drilling fluid.

Figure 10:
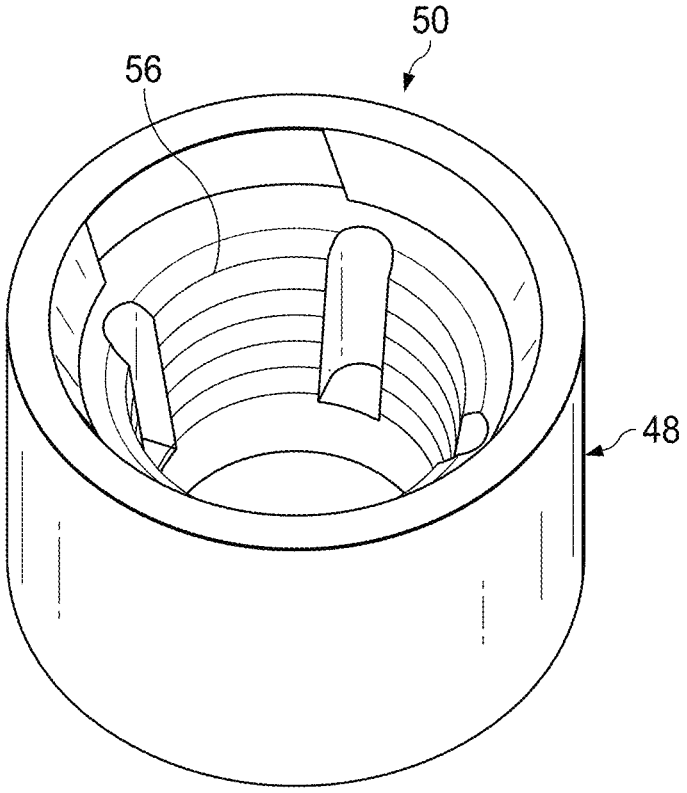
FIG. 10 illustrates an exemplary seat configured to shear or broach a shearable activation device.

FIG. 10 illustrates an exemplary seat 48, which is described with additional reference to FIGS. 1-9. Seat 48 illustrated in FIG. 10 is a broaching seat configured to shear outer shell 32, e.g. shear a portion of outer shell 32. Seat 48 includes two or more progressive cutting edges 56 circumscribing bore 50. The internal diameter of cutting edges 56 defining bore 50 may decrease in the downhole direction.

Figure 11:
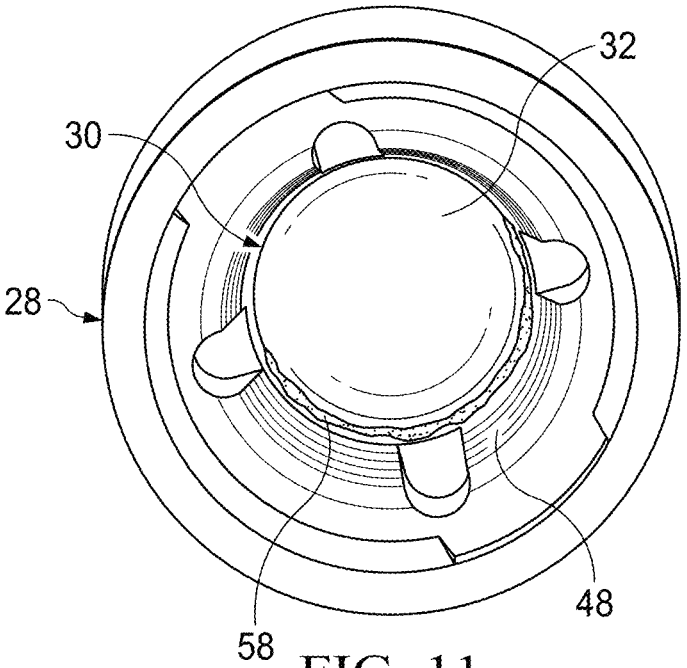
FIG. 11 illustrates a shearable activation device being sheared or broached by a seat of a downhole tool.

FIG. 11 illustrates an example of an activation device 30 being broached or sheared by a seat 48 resulting in activation device 30 passing through seat 48 and downhole tool 28. A portion 58 of outer shell 32 is sheared off of activation device 30 as it is broached by seat 28. The broaching reduces the outside diameter of outer shell 32 allowing activation device 30 to pass through seat 48 without deforming or otherwise expanding seat 48. The broaching may fracture outer shell 32 resulting in fractured outer shell 32 and the unconsolidated core passing through seat 48.

With reference to FIGS. 1-11, activation device 30 travels through the drill string until it reaches seat 48 of downhole tool 28. Seat 48 catches activation device 30 substantially blocking throughbore 50 of downhole tool 28. Seat 28 may have slots, apertures or other suitable forms of bypass channels that remain open to allow drilling fluid to continue to flow past activation device 30 when it is in the seat. The flow of drilling fluid past the activation device is typically reduced compared to the flow of drilling fluid through the central bore of the downhole tool that is possible when the seat is empty. The pressure of drilling fluid 26 increases when activation device 30 is landed on seat 48. The increased force acting on activation device 30 operates downhole tool 28 from one position to another position. After activating downhole tool 28, outer shell 32 is broached or sheared by seat 48 causing activation device 30 to pass through seat 48 without deforming seat 48.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include such elements or features.

As used herein, the terms "connect," "connection," "connected," "in connection with," and "connecting" may be used to mean in direct connection with or in connection with via one or more elements. Similarly, the terms "couple," "coupling," and "coupled" may be used to mean directly coupled or coupled via one or more elements. Terms such as "up," "down," "top," and "bottom" and other like terms indicating relative positions to a given point or element may be utilized to more clearly describe some elements. Commonly, these terms relate to a reference point such as the surface from which drilling operations are initiated.

The term "substantially," "approximately," and "about" is defined as largely but not necessarily wholly what is specified (and includes what is specified; e.g., substantially 90 degrees includes 90 degrees and substantially parallel includes parallel), as understood by a person of ordinary skill in the art. The extent to which the description may vary will depend on how great a change can be instituted and still have a person of ordinary skill in the art recognized the modified feature as still having the required characteristics and capabilities of the unmodified feature. In general, but subject to the preceding, a numerical value herein that is modified by a word of approximation such as "substantially," "approximately," and "about" may vary from the stated value, for example, by 0.1, 0.5, 1, 2, 3, 4, 5, 10, or 15 percent.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure and that they may make various changes, substitutions, and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. An activation device for a downhole tool, the activation device comprising:

an outer shell formed of a consolidated sand and encapsulating an unconsolidated sand; and a structure inside of the outer shell formed of the consolidated sand.

2. The activation device of claim 1, wherein the outer shell comprises a groove formed on an external surface.

3. The activation device of claim 1, wherein the outer shell comprises a plurality of dimples formed on an external surface.

4. The activation device of claim 1, wherein the outer shell is formed of a silica sand bonded with a furan resin bonding.

5. The activation device of claim 1, wherein the outer shell is approximately 99.9 percent silica sand bonded with a furan resin; and a grain size of the silica sand is about 0.10 mm to 0.25 mm.

6. The activation device of claim 1, wherein the outer shell is formed of approximately 99.8 percent silica sand with a grain size of about 0.105 mm.

7. A wellbore system, the system comprising:

an actuatable downhole tool comprising a seat having a throughbore and two or more cutting edges circumscribing the throughbore; and an activation device comprising an outer shell formed of a consolidated sand and encapsulating an unconsolidated sand, the activation device sized to land on the seat and in response to a hydraulic pressure actuate the downhole tool, whereby the two or more cutting edges shear the outer shell to allow the activation device to pass through the throughbore.

8. The system of claim 7, wherein the activation device further comprises a structure inside of the outer shell, the structure formed of the consolidated sand.

9. The system of claim 7, wherein the outer shell comprises at least one of a groove formed on an external surface or dimples formed on the external surface.

10. The system of claim 7, wherein the activation device further comprises:

a structure inside of the outer shell, the structure formed of the consolidated sand; and at least one of a groove formed on an external surface or dimples formed on the external surface.

11. A method comprising:

landing an activation device on a seat of a tool located in a tubular string in a wellbore, wherein the activation device comprises an outer shell formed of a consolidated sand, the seat comprises two or more cutting edges circumscribing a throughbore of the seat, and an internal diameter of the two or more cutting edges decreases in a downhole direction;

actuating the tool in response to a hydraulic pressure applied to the activation device landed on the seat;

shearing the outer shell with the seat in response to the hydraulic pressure; and passing the activation device through the seat.

12. The method of claim 11, wherein the outer shell encapsulates an unconsolidated sand.

13. The method of claim 11, wherein the activation device comprises a structure inside of the outer shell, the structure formed of the consolidated sand.

14. The method of claim 11, wherein the activation device comprises a structure inside of the outer shell, the structure formed of the consolidated sand; and the outer shell encapsulates an unconsolidated sand.

15. The method of claim 11, wherein the wherein the outer shell comprises a groove formed on an external surface.

16. The method of claim 15, wherein the outer shell encapsulates an unconsolidated sand.

17. The method of claim 15, wherein the activation device comprises a structure inside of the outer shell, the structure formed of the consolidated sand.

18. The method of claim 15, wherein the activation device comprises a structure inside of the outer shell, the structure formed of the consolidated sand; and the outer shell encapsulates an unconsolidated sand.

19. The method of claim 11, wherein the outer shell comprises a plurality of dimples formed on an external surface.

20. The method of claim 19, wherein the activation device comprises a structure inside of the outer shell, the structure formed of the consolidated sand; and the outer shell encapsulates an unconsolidated sand.

* * * * *